United States Patent [19]

Spanel

[11] 4,063,353

[45] Dec. 20, 1977

[54] HAIRCUTTERS FEATURING BLADE HOLDING MEANS

[76] Inventor: Abram N. Spanel, 344 Stockton St., Princeton, N.J. 08540

[21] Appl. No.: 741,004

[22] Filed: Nov. 11, 1976

[51] Int. Cl.[2] ..... B26B 21/12

[52] U.S. Cl. ..... 30/30; 30/330

[58] Field of Search ..... 30/30, 31, 330, 331, 30/339, 332, 333

[56] References Cited

U.S. PATENT DOCUMENTS

| | | | |
|---|---|---|---|
| 1,351,987 | 9/1920 | Barro | 30/330 |
| 2,313,598 | 3/1943 | Stock | 30/331 |
| 2,463,682 | 3/1949 | Doniger | 30/331 |
| 2,746,144 | 5/1956 | Spanel | 30/31 |
| 2,814,112 | 11/1957 | Gore | 30/339 |
| 2,977,668 | 4/1961 | Maness | 30/331 X |

*Primary Examiner*—Jimmy C. Peters

*Attorney, Agent, or Firm*—J. Rodman Steele, Jr.

[57] ABSTRACT

Improved haircutters which utilize a razor-like blade, said haircutters including a blade holder having a base blade support and a clamp member. The clamp member is positionable on a supported blade and includes a clamping lever which is engageable with a clamping pin-like member which may be projecting from said base blade support. In a preferred embodiment, the blade can be laterally adjusted to a series of hair cutting positions.

18 Claims, 8 Drawing Figures

HAIRCUTTERS FEATURING BLADE HOLDING MEANS

BACKGROUND OF THE INVENTION

The subject invention relates to a blade holding or securing means which is particularly adaptable for use with home haircutters that can be safely used by men, women, and children for hair cutting, trimming and/or grooming.

In today's society, there is ever-increasing emphasis on consumer protection, and the safety of any device and, particularly, those which utilize potentially dangerous components such as a razor blade, must be given special attention. In recent hair cutters designed by the inventor of the subject disclosure, Abram N. Spanel, emphasis has been placed upon making relatively safe and durable cutters which are also functionally superior to previously known haricutters. See U.S. Pat. Nos. 3,802,712; 3,885,305; 3,885,695; and 3,855,696. See also earlier U.S. Pat. No. 2,731,717.

The subject disclosure relates to a blade holding means adaptable for use in the above types of haircutters wherein the holding means positively engages the blade so that it may not be jarred loose or otherwise dangerously detached during hair cutting operations. As disclosed in the aforementioned U.S. Pat. No. 3,885,305, a blade clamp 12 was utilized in conjunction with slotted studs 13 which protruded through the blade and the blade clamp 12. This structure also is utilized in aforementioned U.S. Pat. No. 3,803,712. As best shown in FIG. 12 of this latter patent, the supported blade engages the flat front surface of the frame member 80 while the blade clamping member 24 is moved over the mounting members 82 which extend through its rectangular openings 86. By pressing against the clamping member 24, the resilient leg portions 92 spread slightly and are held in that position by sliding the clamping member 24 to the right so that the smaller rectangular portions 88 are received within the grooves 90 of the mounting members 82. Thus, the blade 20 is frictionally held in position.

While the above design has advantages, the blade is, nevertheless, not held in positive engagement by the blade support means. If the haircutter is jarred, the clamping member may slip, thus permitting the blade to become disengaged. Also, over an extended period of time, leg portions 92 can lose their resiliency and, accordingly, the clamping action may not be as positive as desired. Furthermore, in utilizing a clamping device such as above-described, the user must exercise particular care to ensure that the blade is fully seated before hair cutting begins.

SUMMARY OF THE INVENTION

In accordance with the subject invention, the subject blade holding unit may be utilized to improve haircutters of the type disclosed in U.S. Pat. No. 3,885,305.

As disclosed, the blade holding means includes a blade support upon which a supported blade is positioned. The blade support may have projection structure which protrudes through the supported slotted, razor-like blade. If projection structure is utilized, a clamp member is positionable on the supported blade and is configured to receive the projection structure of the blade support. A clamping or locking lever is pivotally mounted upon a portion of the clamp member and includes locking structure which engages mating structure of the projection structure. By depressing the clamping lever when the supported blade is in position beneath the clamp member, the blade can be held in positive, locked engagement as the clamping lever-locking structure engages the projection structure. Only upon release of the clamping lever will the blade be released. Accordingly, it will be appreciated that potential safety problems with the type of blade support structure disclosed in aforementioned U.S. Pat. No. 3,885,305 can be avoided.

The blade holding means described herein may be used on any number of types of haircutters with the haircutters of aforementioned U.S. Pat. Nos. 3,885,305 and 3,803,712 being but two examples. As shown in U.S. Pat. No. 3,885,305, the blade, once secured, may be laterally adjusted to a series of hair cutting positions. To permit easy accessibility for changing the blade, the blade carrier may be slidable free of the protective cage, or, in the alternative, the cage itself may be slidable to permit access to the blade for changing purposes.

DETAILED DESCRIPTION

Figure 1:
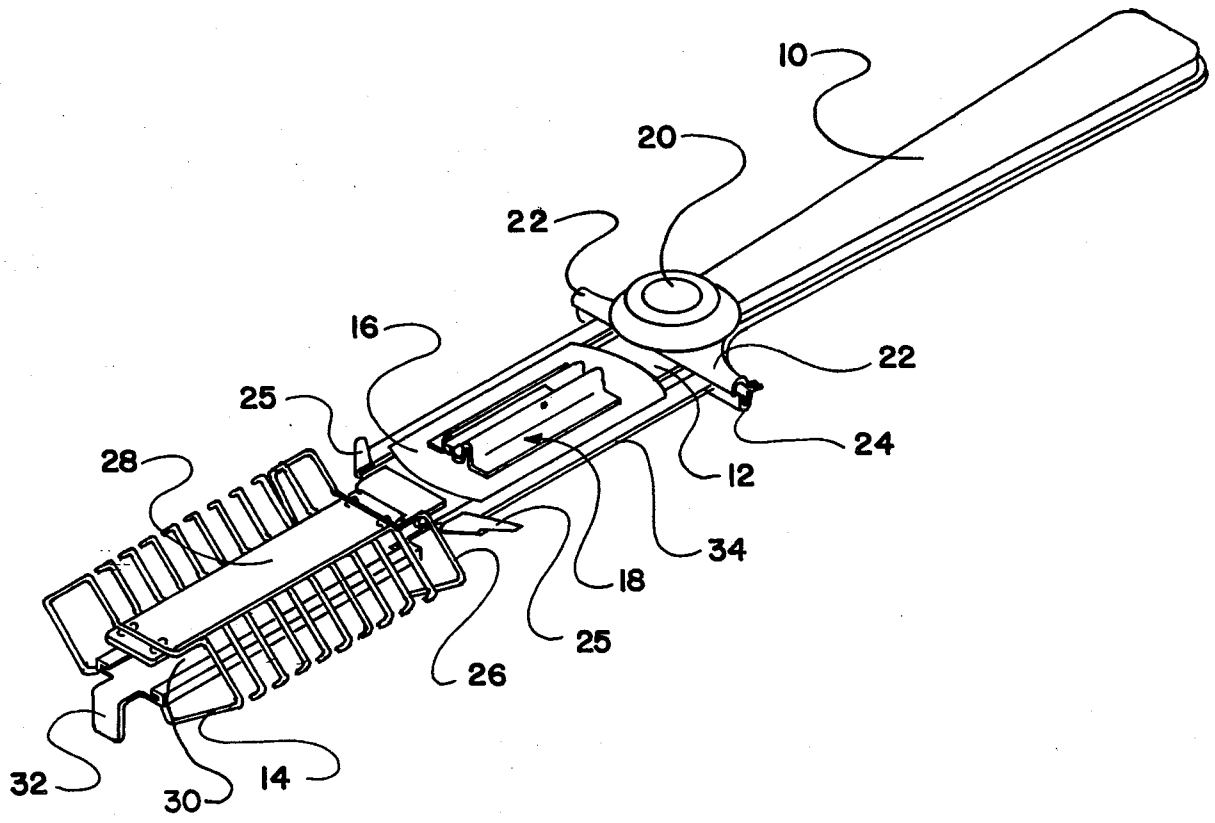
FIG. 1 is an isometric view in which a haircutter is shown with cage extended to provide access to the haircutter blade for blade changing purposes.
Figure 5:
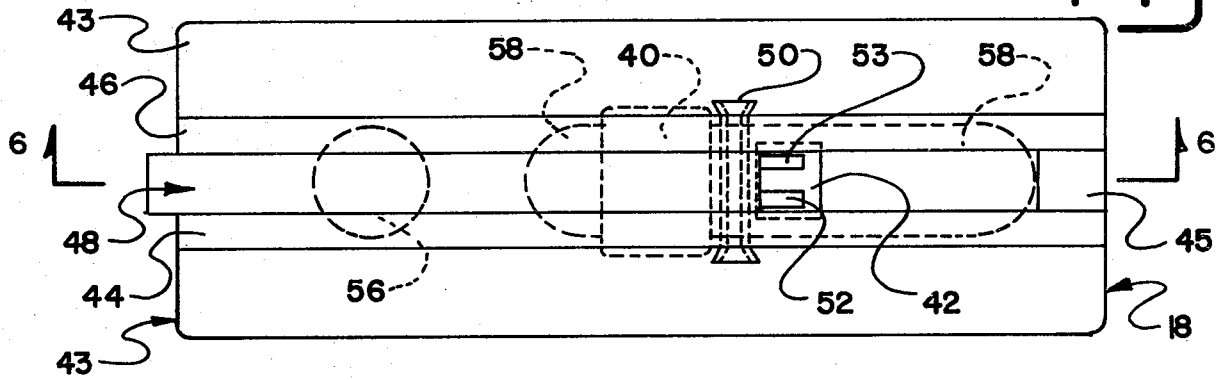
FIG. 5 is a top view of the blade clamp member of FIG. 3.

With reference to FIG. 1, a haircutter is shown for which the subject blade holding means was particular utility. The haircutter is shown comprising as main components a handle 10, a blade table or blade support 12, for supporting a blade, and a wire tine cage 14 which serves to protect the user during hair cutting operations. As shown in FIG. 1, the cage 14 can be extended outwardly to permit access to the blade table or blade support 12 for changing blades. A slotted razor-like blade 16 is shown supported by the blade support 12 with clamping member 18 being shown placed on blade 16. As can be seen in FIG. 5, the blade 16 is shown having a slot 17.

With further reference to FIG. 1, a thumb knob 20 is used to control lateral movement of the blade table or blade support 12 and the blade 16 to enable the blade 16 to be adjusted to a series of selectable hair cutting positions where the blade 16 will be at varying distances from the apices of the tine members which make up cage 14.

As shown, handle 10 terminates in structures 22 and 24 which form upper and lower bearing surfaces, respectively, for a portion of the lateral driving mechanism (not shown) in FIG. 1.

Bearing structure 25 located at the opposite end of the haircutter from the handle is also shown which supports the blade table 12 and the cage 14 is shown comprising individual wire tine members 26 which are secured to upper and lower spine members 28 and 30, respectively. The lower spine member 30 terminates in a pull tab 32 which is to be used for pulling the cage 14 to the extended position as shown in FIG. 1. Frame structure 34 is shown extending outwardly of blade 16 and, as disclosed in aforementioned U.S. Pat. No. 3,885,305, the haircutter may employ means to prevent the cage 14 from being extended except when the blade is in a centered position, thus providing a safety measure since, in such centered position, the edges of the blade 16 do not extend outwardly past frame structure 34.

Track structure which permits the cage 14 to slide longitudinally is not shown in detail and may be on the order of the structure of aforementioned U.S. Pat. No. 3,885,305.

Figures 2, 7, 8:
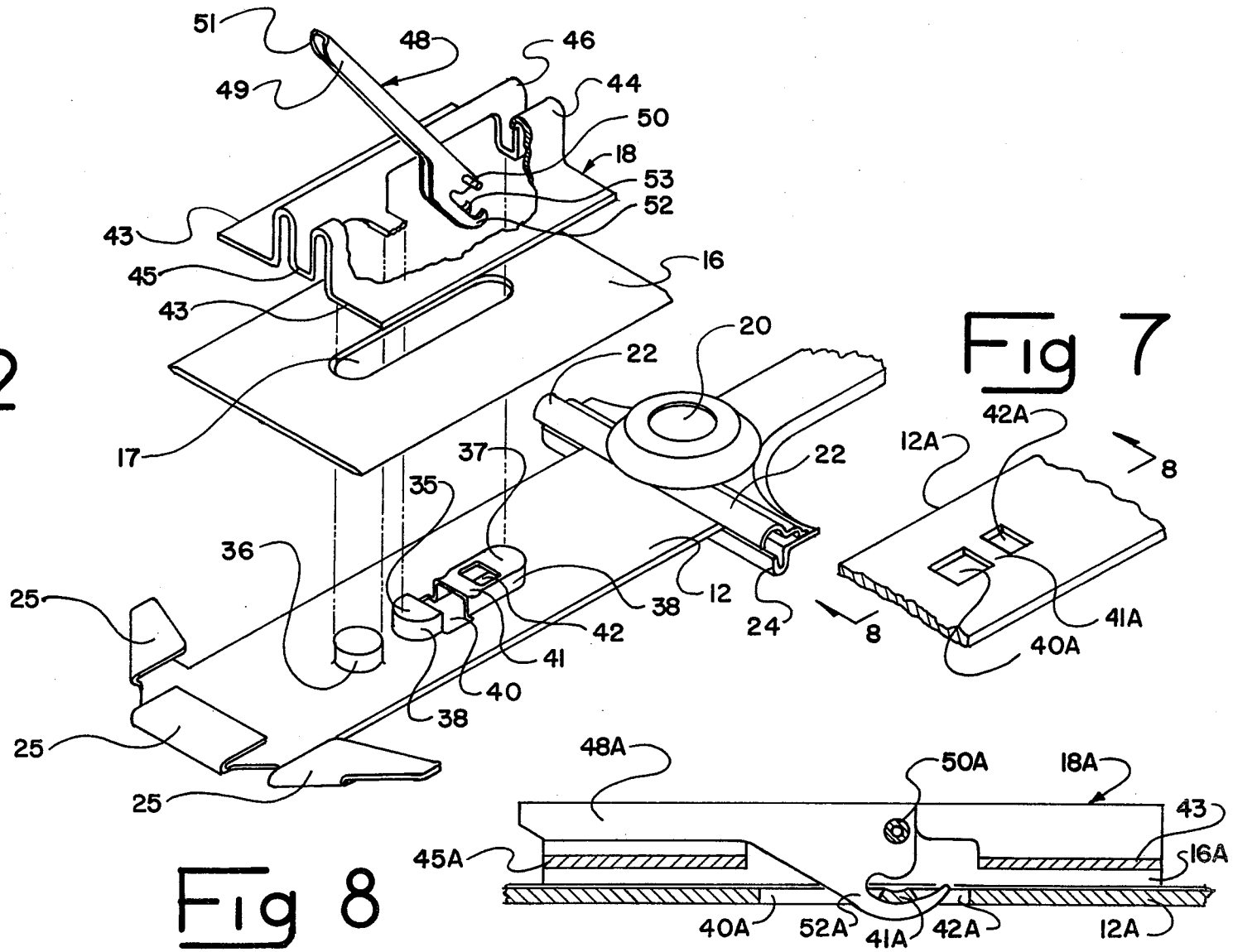
FIG. 2 is an exploded isometric view showing, in detail, the blade support means, the blade and the blade clamping member.
FIG. 7 is a partial view of a modified portion of FIG. 6 showing a modified blade support without projection structure and wherein the clamping bar is at the same level as the blade support; and, FIG. 8 is a cross-sectional view taken along lines 8—8 of FIG. 7 and showing a blade clamping member in clamping position.

Details of the blade holding structure can be seen from FIGS. 2–6. As shown in FIG. 2, the blade 12, has projection elements or structure including a positioning nub 36 and a two-part elongated projection 38, the latter which comprises surfaces 35 and 37. The elongated projection 38 assists in precisely positioning the blade as well as providing clamping structure. As further shown in FIG. 2, openings 40 and 42 are shown in projection 38 which set apart a cross or clamping bar 41, to be engaged by the blade clamp 18, as will be described.

Figure 3:
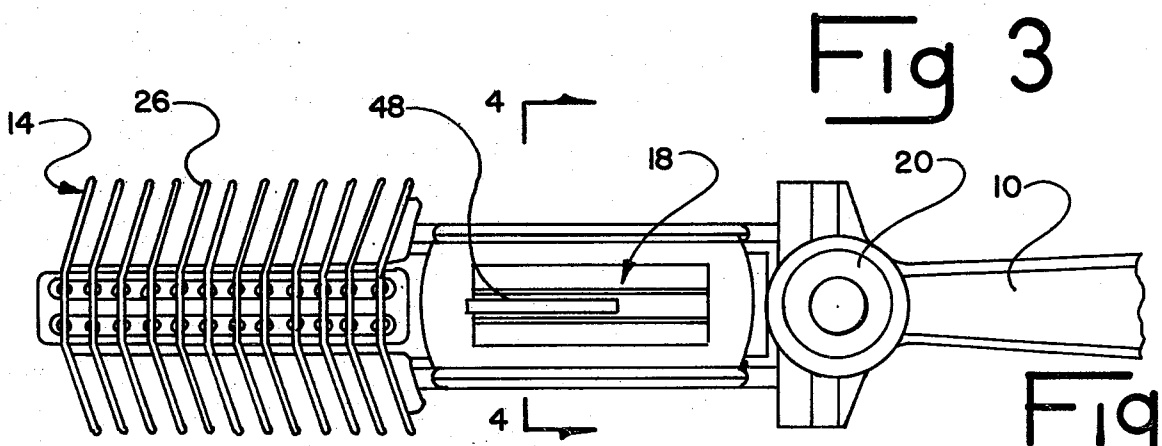
FIG. 3 is a top view of the blade support area of the embodiment of FIG. 2, showing a blade in its clamped position.
Figure 4:
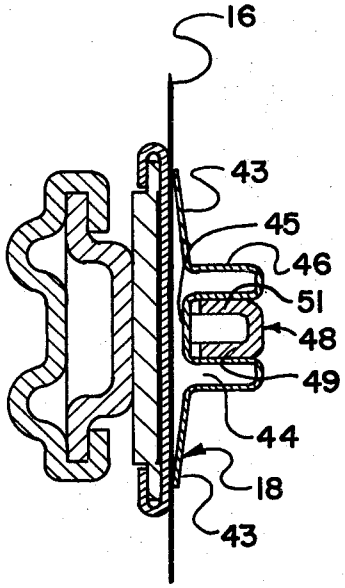
FIG. 4 is a cross-sectional view taken along the lines 4—4 of FIG. 3.

Blade clamp 18 is shown having blade engaging wings or surfaces 43 and inverted U-shaped upright walls 44 and 46 which are substantially perpendicular to the blade engaging surfaces or wings 43 as shown in FIG. 2. A center surface 45 is formed between the upright walls 44 and 46. Clamping lever 48 is pivotally secured to upright walls 44, 46 by means of a pivot pin 50. The clamping lever 48 is shown as being essentially U-shaped and having legs 49 and 51. The clamping lever 48 is shown having a hook-like terminus formed by hook-like structure 52, 53 extending from each of legs 49 and 51. These hook-like members 52, 53 are engageable with clamping bar 41 of the projection 38 which extends upwardly from blade table 12. The clamping lever 48 may be constructed to firmly fit between sidewalls 44 and 46, as best seen in FIG. 3 and 4.

The pivot pin 50 may be a solid pin which is secured by flaring out the ends or it may be a tube with ends flared once the pin 50 has been seated. See FIG. 5.

Figure 6:
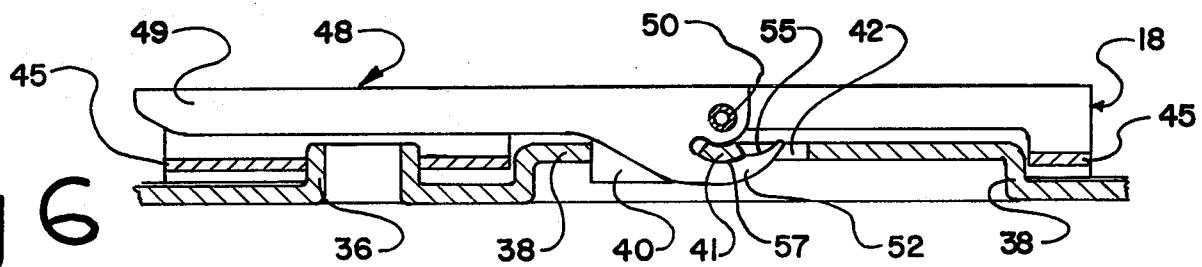
FIG. 6 is a cross-sectional side view taken along the lines 6—6 of FIG. 5.

As can be seen from FIGS. 5 and 6, aperture 56 through surface 45 is blade clamp 18 receives positioning nub 36 as the blade clamp 18 is placed over the projection structure of blade table 12. If a blade 16 is supported on blade table 12, then it will be understood that when clamping member 18 is placed on the blade 16, the projection elements 36 and 38 will extend through he blade slot 17 and into engagement with blade clamp 18. As the blade clamp 18 is placed upon blade 16, the clamping lever 48 is held in an upwardly inclined position, as shown in FIG. 12, until the hook-like members 52, 53 fit into opening 40 as positioning nub 36 and projection 38 are received in aperture 56 and apertured slot 58, respectively. Once positioning nub 36 and projection 38 are seated, then clamping lever 48 may be depressed to the position shown in FIGS. 3–6 thus causing the hook-like members 52, 53 to lock and engage clamping bar 41, thereby securing the clamp member 18 firmly against blade 16.

As best seen in FIG. 6 each of the hook-like members 52, 53 is comprised of two inner surfaces 55, 57 of different radii. The first surface 55 is closer to the tip of 52 and first engages clamping bar 41 as the lever 48 is depressed when the blade clamp 18 is properly seated. The first surface 55 on each of members 52, 53 serves as a camming surface or inclined plane which effectively pulls the blade clamp 18 positively downward as the first surface 55 engages clamping bar 41 as lever 48 is depressed.

As this engagement occurs the action of blade clamp 18 can best be viewed by considering the blade clamp 18 as a cantilever spring. The end view of FIG. 4 shows the tips of the blade engaging surfaces or wings 43 impacting against blade 17. As downward pressure is exerted on lever 48 as camming surfaces 55 engage clamping bar 41, the blade clamp 18, and particularly surface 45 is drawn or cammed closer to blade 17 thus firmly securing the blade 17 between blade support 12 and blade clamp 18. The blade clamp may be constructed of thin steel or other material to permit spring-like resiliency, if desired.

The second surface 57 of each member 52, 53 represents a neutral type locking position and once the lever 48 is depressed and the hook-like members or jaws 52, 53 are fully extended, surfaces 57 will engage clamping bar 41 thus locking the blade 17 firmly in position. Upward force on the lever 48 will be necessary to cause clamping bar 41 to be released by members or jaws 52, 53.

As can be appreciated from FIG. 4, when lever 48 is depressed it may be tightly wedged within sidewalls 44 and 46 to further ensure that the lever 48 is secured in a locking position. A reasonable amount of energy is necessary to lift lever 48, thus releasing the clamping action.

An alternate embodiment of the subject invention is shown in FIGS. 7 and 8. As shown in FIG. 7, a blade table 12A may, in place of the projection structure of the embodiment of FIG. 2, have a clamping bar 41A formed by the openings 40A and 42A.

As shown in FIG. 8, a blade 16A will be sandwiched between the blade table 12A and blade clamping surfaces 43A of blade clamp 18A. A slotted blade is utilized and positioning nubs (not shown) may be used to position the blade 16A as precisely as desired. The clamping lever 48A pivots about pivot pin 50A as in the previously described embodiment (FIGS. 2–6), however, the hook-like clamping members 52A are dimensionally different from the previous embodiment since they must extend lower and engage clamping bar 41A at a lower level when the clamping bar is not included as part of the projection structure as in FIGS. 2–6.

Once a blade 16 is firmly secured, the cage 14, assuming that it is in its extended position, as shown in FIG. 1, may be returned to a position where the blade 16 is surrounded. The blade 16 and table 12 may now be adjusted laterally by thumb knob 20 so that the desired hair cutting position of the blade 16 may be achieved.

It will be readily appreciated that blade 16 may be removed the replaced by lifting or raising clamping lever 48, thus causing the hook-like members 52, 53, 52A to pivot about pivot pin 50. As this occurs and clamping bar 41, 41A is released, the blade clamp 18 may be lifted, thus permitting the easy removal of the blade 16.

The present invention may be embodied in other specific forms and ways without departing from the spirit or essential attributes thereof and, accordingly, reference should be made to the appended claims, rather than to the foregoing specification as indicating the scope of the invention.

I claim:

1. A hair cutter or the like utilizing a supported, apertured razor-like blade, said hair cutter having a blade holding means comprising:

a blade support including a clamp bar; and a detachable clamp member positionable on said supported blade, said clamp member including a clamp lever having a portion engageable with said clamping bar through said aperture whereby upon engagement said supported blade will be secured between said blade support and said clamp member.

2. The haircutter and blade holding means of claim 1 wherein said blade support includes projection structure on which said clamping bar is positioned, said projection structure extending through said aperture and including locking structure with said clamping lever portion.

3. The haircutter and blade holding means of claim 2, wherein said aperture comprises a slot and wherein said projection structure includes positioning structure.

4. The haircutter and blade holding means of claim 1, wherein said clamp member includes blade engaging surfaces and wall structure, and wherein said clamping lever is pivotally mounted to said wall structure.

5. The haircutter and blade holding means of claim 1, wherein said clamping lever includes a hook-like terminus engageable with said clamping bar, said hook-like terminus including a first receiving surface for first engaging said clamping bar and a second clamping surface for locking said clamping lever to said clamping bar.

6. A hair cutter or the like utilizing a supported razor-like blade, said hair cutter having a blade holding means comprising:

a blade support including a clamping bar;

a clamp member positionable on said supported blade, said clamp member including a clamp lever having a portion engageable with said clamping bar whereby upon engagement said supported blade will be secured between said blade support and said clamp member; and, said clamp member including blade engaging surfaces and wall structure, said clamping lever being pivotally mounted to said wall structure and said wall structure forming a channel for said clamping lever.

7. The haircutter and blade holding means of claim 6, wherein said clamping bar is positioned on projection structure and wherein said blade engaging surfaces include openings for receiving said projection structure.

8. The haircutter and blade holding means of claim 7, wherein said projection structure is disposed so as to protrude through a slot in said blade thereby positioning said blade on said blade support.

9. The haircutter and blade holding means of claim 6, wherein said channel receives said clamping lever to assist in frictionally holding said clamping lever in a locked position.

10. The hair cutter and blade holding means of claim 5, wherein the clamping lever is substantially U-shaped in cross-sectional and wherein two depending legs each form said hook-like terminus.

11. A haircutter or the like utilizing a supported slotted razor blade, said haircutter having a blade holding means comprising:

a blade support including projection structure which extends through the slot of said supported blade, said projection structure including a clamping bar positioned in a substantially parallel plane to that of said supported blade; and, a detachable clamp member positionable on said supported blade comprising at least one clamping surface engageable with said supported blade, and a clamping lever including a portion engageable with said clamping bar.

12. A haircutter or the like for utilizing a razor blade, said haircutter having a blade holding means comprising:

a blade support including projection structure which extends through said blade, said projection structure including a clamping bar and further having at least one opening adjacent said clamping bar; and, a detachable clamp member engageable with said blade comprising at least one clamping surface engageable with said blade, and a clamping lever including a portion insertable in said at least one opening and engageable with said clamping bar.

13. The haircutter of claim 12 wherein at least one opening is on one side of said clamping bar and a second opening is on the other side of said clamping bar and wherein said insertable portion of said clamping lever partially surrounds and hooks said clamping bar upon engagement therewith.

14. A haircutter or the like utilizing a supported slotted razor blade, said haircutter comprising:

a cage made up of a plurality of elements;

a blade carrier positionable within said cage for supporting a blade for lateral movement in either of two directions, said blade carrier including projection structure which extends through the slot of said supported blade, said projection structure including a clamping bar; and, a detachable clamp member positionable on said supported blade comprising clamping surfaces engageable with said supported blade, and a clamping lever including a portion engageable with said clamping bar.

15. A haircutter or the like utilizing a supported slotted razor blade, said haircutter comprising:

an adjustable blade carrier for supporting a blade including projection structure which extends through the slot of said supported blade, said projection structure including a clamping bar; and, a detachable clamp member positionable on said supported blade comprising clamping surfaces engageable with said supported blade, and a clamping lever having a terminus which is engageable with said clamping bar.

16. A haircutter or the like utilizing a supported slotted razor blade, said haircutter having a blade holding means comprising:

a blade support including projection structure which extends through the slot of said supported blade, said projection structure including a clamping bar substantially parallel to said supported blade; and, a detachable clamp member positionable on said supported blade comprising clamping surfaces engageable with said supported blade, substantially upright wall structure extending from said clamping surfaces, and a clamping lever pivotally mounted on said wall structure including a hooking portion engageable and securable with said clamping bar.

17. The haircutter and blade holding means of claim 16 including a tubular pivot element about which said clamping lever is pivotally mounted.

18. The haircutter and blade holding means of claim 17 in which the ends of said tubular pivot element are flared.

* * * * *

UNITED STATES PATENT OFFICE

CERTIFICATE OF CORRECTION

Patent No. 4,063,353 Dated December 20, 1977

Inventor(x) Abram N. Spanel

It is certified that error appears in the above-identified patent and that said Letters Patent are hereby corrected as shown below:

Column 2, line 48, delete "was" and insert --has--.
Column 3, line 23, after "blade" insert --table--.
Column 3, line 53, delete "is" and insert --in--.
Column 3, line 59, delete "he" and insert --the--.
Column 3, line 62, delete "12" and insert --2--.
Column 4, line 63, delete "the" and insert --and--.

Signed and Sealed this

Second Day of May 1978

[SEAL]

Attest:

RUTH C. MASON
Attesting Officer

LUTRELLE F. PARKER
Acting Commissioner of Patents and Trademarks